US005558148A

United States Patent [19]

Uzaki et al.

[11] Patent Number: 5,558,148

[45] Date of Patent: Sep. 24, 1996

[54] METHOD OF PRODUCING MOLDS

[75] Inventors: Nagato Uzaki, Toyohashi; Ukichi Oishi, Toyokawa; Ryoji Kanayama, Toyohashi; Hironobu Amano; Tokiya Terabe, both of Toyokawa, all of Japan

[73] Assignee: Sintokogia, Ltd., Achi, Japan

[21] Appl. No.: 435,476

[22] Filed: May 5, 1995

[30] Foreign Application Priority Data

May 12, 1994 [JP] Japan ..... 6-124586

[51] Int. Cl.[6] ..... B22C 15/264; B22C 15/276; B22C 15/28

[52] U.S. Cl. ..... 164/7.1; 164/37; 164/38

[58] Field of Search ..... 164/7.1, 7.2, 37, 164/38, 195

[56] References Cited

U.S. PATENT DOCUMENTS

| | | | |
|---|---|---|---|
| 4,230,172 | 10/1980 | Uzaki et al. | 164/195 X |
| 4,620,584 | 11/1986 | Witt | 164/195 X |
| 4,921,035 | 5/1990 | Leutwiler | 164/7.1 X |
| 5,348,070 | 9/1994 | Fischer et al. | 164/38 |

FOREIGN PATENT DOCUMENTS

| | | | |
|---|---|---|---|
| 4126962 | 2/1993 | Germany | 164/38 |
| 58-107251 | 6/1983 | Japan | 164/37 |
| 63-171246 | 7/1988 | Japan | 164/37 |
| 1-113152 | 5/1989 | Japan | 164/37 |
| 5-76990 | 3/1993 | Japan | 164/37 |
| 1533820 | 1/1990 | U.S.S.R. | 164/7.1 |

*Primary Examiner*—J. Reed Batten, Jr.
*Attorney, Agent, or Firm*—Limbach & Limbach

[57] ABSTRACT

Molding sand (5) is fed into a space defined by a pattern plate (2) and a flask (3) mounted on the pattern plate (2), and the space is enclosed at the upper part of the flask (3) by a cover (6). The air in the enclosed space is evacuated to reduce the air pressure between the grains of the molding sand in the enclosed space to 1 Torr to 150 Torr, and then air is introduced into the enclosed space from the upper part of the space so that the pressure in the space can increase at the rate of 15 atm/s to compress the molding sand (5). The method eliminates the need for vent holes and enables the mold to be crack-free since the air flow is not reflected.

6 Claims, 3 Drawing Sheets

METHOD OF PRODUCING MOLDS

FIELD OF THE INVENTION

This invention relates to a method for producing a mold wherein molding sand is fed into a molding space defined by a pattern plate and a flask, and is then pressed by air flow.

BACKGROUND OF THE INVENTION

A conventional method of compressing the molding sand, which is fed in a molding space defined by a pattern plate and a flask placed on the pattern plate, by applying air to the sand, especially applying impulse pressure by compressed air, is known by JP Patent, A, 58-502090.

However, since the compressed air used in the conventional method is generated by an air compressor, a small amount of lubricant is contained in the air, and, when the used compressed air is discharged into the atmosphere, the lubricant in the air and tiny particles contained in the molding sand are also released together with the air. This tends to adversely affect the environment.

Further, it is known in a method that uses compressed air to form vent holes in deep pockets to enhance compaction (as taught, for example, by Japanese Patent, A, 55-120450).

However, forming a vent hole in a pattern increases the cost to make the pattern. Further, vent holes cannot be formed at any desired position because if one would be formed in a surface of the pattern that corresponds to a matching surface at which the mold and the molten metal contact, the surface of a product to be molded would bear the mark of the hole, thereby decreasing the quality of the product.

Further, when an impulse pressure by compressed air is used, the reflected impulse pressure causes cracks in the mold.

This invention is made in view of the above problems. The purpose of the invention is to provide a method to easily produce a mold without causing cracks therein and without forming any vent hole in the pattern, while at the same time making the environment clean.

SUMMARY OF THE INVENTION

To accomplish the purpose of the invention, this invention provides a method of producing a mold that includes the steps of feeding molding sand into a space defined by a pattern plate and a flask mounted on the pattern plate; covering an upper part of the flask by a closing cover; and then pressing the molding sand by using air flow, characterized in that the method further includes the steps of: evacuating air from the space closed by the pattern plate, the flask, and the closing cover to make the space a vacuum so that the air pressure between the grains of the molding sand in the space can be between 1 Tort to 150 Tort, and introducing air into the space from an upper part of the space so as to increase the pressure in the space to ambient pressure at pressure gradient of at least 15 atm/s thereby compressing the molding sand. Hereinafter the air flow caused by this method will be called "vacuum air flow."

The above method may further include a mechanical compaction after the compaction by the vacuum air flow, characterized in that the mechanical compaction includes the steps of inserting a pressing plate in the space within the closing cover in a sealing relationship therewith and fixedly supporting the plate in the cover; evacuating air from the space closed by the pattern plate, the flask, the closing cover, and the pressing plate, to make the space a vacuum; and releasing the pressing plate from the support while maintaining the vacuum in the space, thereby lowering the pressing plate by the pressure difference between the ambient pressure exerted on the plate and the vacuum, to press the molding sand.

In the above structure of the invention the molding sand can be compacted to produce a mold not by using compressed air, but by using the pressure difference between the atmospheric pressure and the vacuum. This eliminates the need for vent holes in the pattern plate and also enables a mold to be produced under the condition where no reflection of the air flow is generated that might cause cracks in the mold if it existed. Further, by adding mechanical compaction to the vacuum air flow, the molding sand is pressed at the lower part mainly by the vacuum air flow, and at the upper part mainly by the mechanical compaction. Therefore, the mold will have a uniform hardness.

DESCRIPTION OF THE PREFERRED EMBODIMENT

Figure 1:
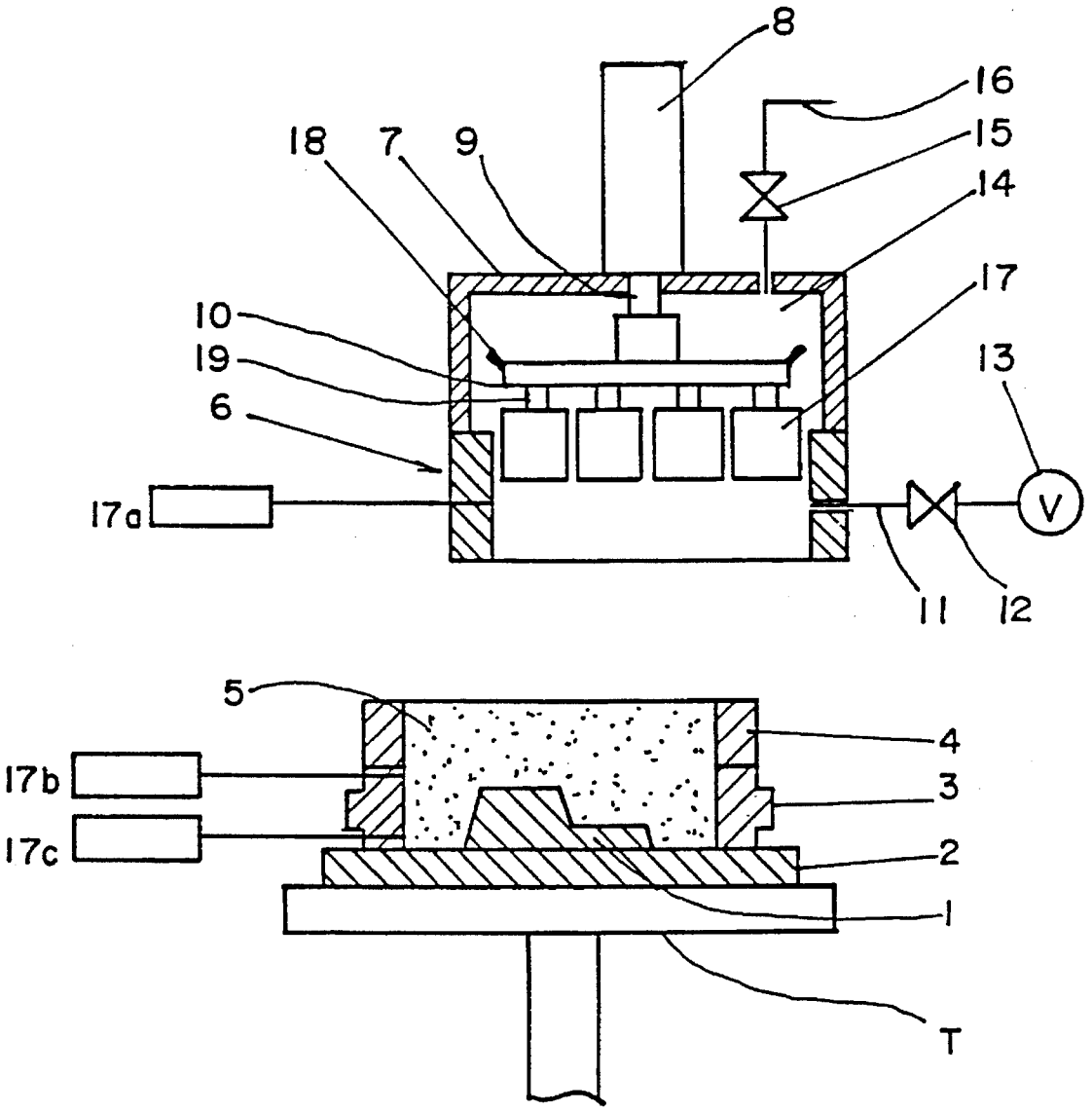
FIG. 1 is a schematic view of an embodiment of the present invention.

A preferred embodiment of the invention will be explained below by referring to the accompanying drawings. In FIG. 1 a molding frame 3 and a filling frame 4 are placed on a pattern plate 2 having a pattern 1. The pattern plate 2 and the molding and filling frames 3, 4 define a molding space into which molding sand 5 is fed. The pattern plate 2 and the molding and filling frames 3, 4 are also placed on a lifting table or lifter T. A horizontally and vertically movable closing cover 6 is disposed above the assembly of the pattern plate and the molding and filling frames. The closing cover 6 has a step such that the upper part of the cover has an inner diameter greater than that of the lower part. A cylinder 8 is mounted in the central part of the ceiling 7 of the closing cover 6. A pressing plate 10 is secured to the distal end of the piston rod 9 of the cylinder 8. The plate 10 can slidably enter the space defined by the lower part of the closing cover 6, which has the smaller inner diameter, in such a manner that the molding space is sealed. The plate 10 is supported and can be releasably locked by locking means (not shown). The inside of the lower part of the closing cover 6 is in communication with an evacuation means 13, or vacuum source, through an aperture, which is formed in a side of the lower part, and, in turn, a vent pipe 11 and a valve 12. The inside space 14 of the closing cover 6 can communicate with the atmosphere at the ceiling 7 of the cover 6 through a valve 15 and a pipe 16. A pressure sensor 17*a* is mounted in the lower part of the closing cover 6, while pressure sensors 17*b* and 17*c* are respectively disposed in the upper and lower part of the assembly of frames 3 and 4. Further, a seal 18 is attached along the circumference of the pressing plate 10, and a split pressing head 17 is suspended from the plate 10 through springs 19.

Figure 2:
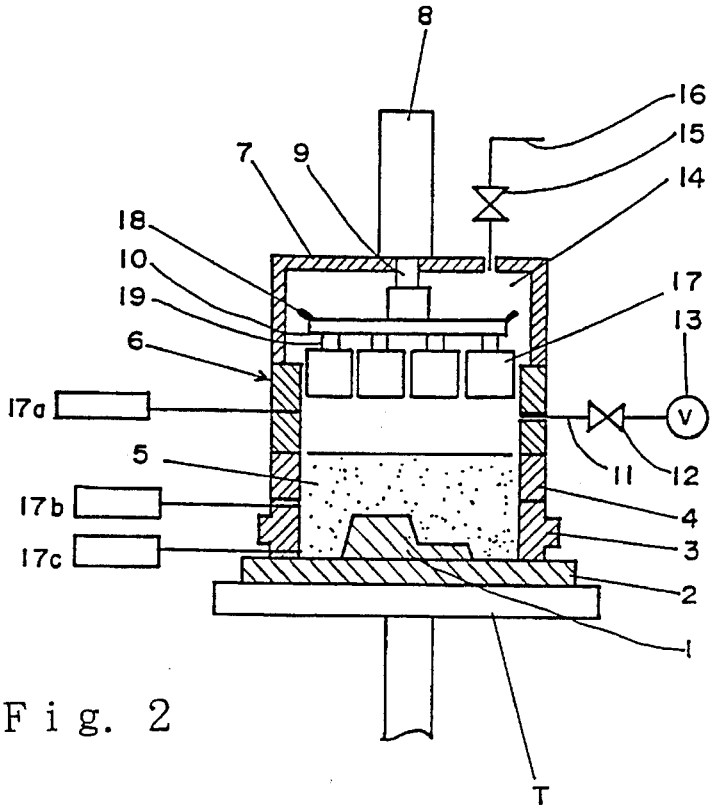
FIG. 2 is a schematic view of the embodiment showing the stage where the vacuum air flow of the invention is applied.

In this arrangement, after molding sand 5 is fed into the molding space, which is defined by the pattern plate 2 and frames (flask) 3, 4, the filling frame 4 and the closing cover 6 are matched as shown in FIG. 2. Then, the evacuation means 13 operates while the valve 12 is opened so as to make the inner space closed by the pattern plate 2, frames 3, 4, and closing cover 6, in a desirable vacuum. After this, the valve 12 is closed, and the valve 15 above the cover is opened to introduce air into the closed space. The air flows into the cavity between the closing cover 6 and the pressing plate 10 and then into the molding sand 5, thereby effecting the first compression of the sand.

Figure 3:
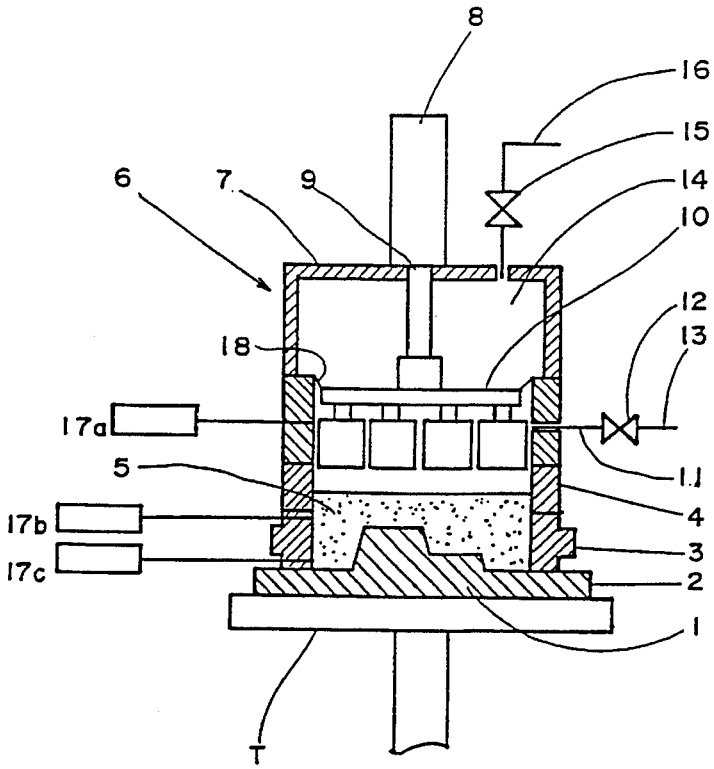
FIG. 3 is a schematic view of the embodiment showing the stage where the mechanical compaction of the invention is applied.

After this, the pressing plate 10 is lowered into the lower part of the closing cover 6 as shown in FIG. 3, i.e., the plate is positioned in the small-diameter part so that the plate 10 and the cover 6 are made airtight, and the plate is then locked by the locking means (not shown) so that it cannot move vertically. The evacuation means 13 then operates to reduce the pressure in the space, which is closed by the pattern plate 2, frames 3, 4, closing cover 6, pressing plate 10, and the seal 18, to a desirable vacuum intensity. At this time a downward force is exerted on the pressing plate 10. The downward force consists of the gravity of the plate and the difference of the pressure between the atmospheric pressure exerted on the upper surface of the plate and the vacuum (reduced pressure) in the closed space. However, since the plate is locked by the locking means (not shown), it is kept in that position. When the intensity of the vacuum becomes a desirable value, the lock of the pressing plate 10 is released to drop it by the resultant downward force. Thus, the split pressing head 17 presses the molding sand 5 in a preferable manner. Then, the pressing plate 10 is moved up by the cylinder 8 to its original position, shown in FIG. 2.

Then, the lifter T is lowered so as to separate the filling frame 4 from the closing cover 6, and the cover is moved away from the flasks 3, 4.

Figure 4:
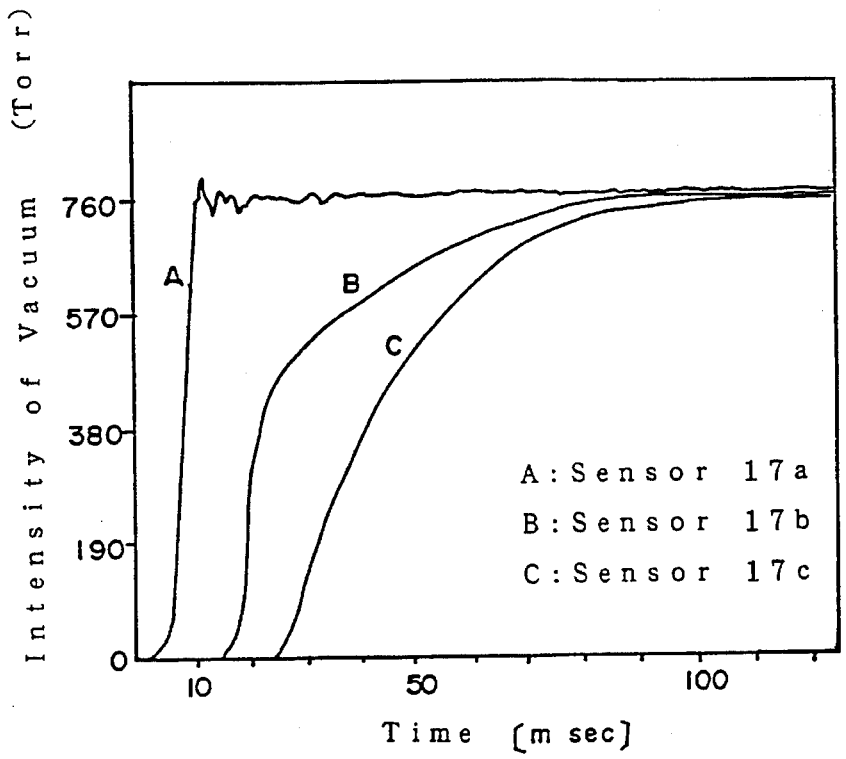
FIG. 4 is a graph to show pressure distribution within the flasks when pressure is applied by the vacuum air flow.

Although in the example shown in the drawings a split pressing head 17 is mounted on the pressing plate 10, the head can be omitted and the molding sand can be compressed by the pressing plate 10 itself. When the atmospheric air was introduced into the closed space as in the form of the vacuum air flow caused by the vacuum source 13 as shown in FIG. 2, the pressures in the closed space were measured by the sensors 17*a*, 17*b*, and 17*c*. The most preferable changes in the pressures are shown in FIG. 4. FIG. 4 is a graph of the pressures A, B, and C (in Tort) which are respectively measured by the sensors 17*a*, 17*b*, and 17*c* versus time (in ms) which has passed after the valve 15 was opened. Below the pressures are explained.

First, the greater the intensity of the vacuum, the greater the effect of the compression, because the air was introduced more rapidly. The intensity of the closed space is preferably 1 Torr to 150 Tort, more preferably 1 Tort to 100 Torr, and most preferably 1 Tort to 50 Tort. In FIG. 4 the pressure is about 1 Tort.

The reason why the intensity of the vacuum is made as 1 Torr to 150 Tort is that if the air pressure is greater than 150 Torr the pressure difference between the air pressure and the atmospheric pressure would be too small, and therefore a large hole would be necessary to introduce air to obtain a proper pressure gradient. Such a large hole is not realistic. If the air pressure is greater than 100 Torr, air present since before the introduction of the vacuum air flow tends to hinder the air flow from being effectively introduced, thereby resulting in a poor introduction of the air flow. Making the air pressure less than 1 Tort would require a large evacuating means. Thus, the pressure of 1 Torr to 50 Torr is most preferable.

If air enters through a small pipe, then however high a degree of vacuum is maintained, the molding sand cannot be well compressed. This means that a certain degree of pressure gradient is necessary. The pressure gradient differs depending on the positions of the pressure sensors. The pressure gradient at the sensor 17*c* was required to be at least 15 arm per second, preferably 30 atm per second. This value can be less than the pressure gradients in the case of the air flow in conventional compressed air.

The reason for this is considered as follows: the degree of compaction of the molding sand by air flow depends on the pressure difference between the pressure in the upper part of the molding sand and the pressure in the sand near the pattern.

Figure 5:
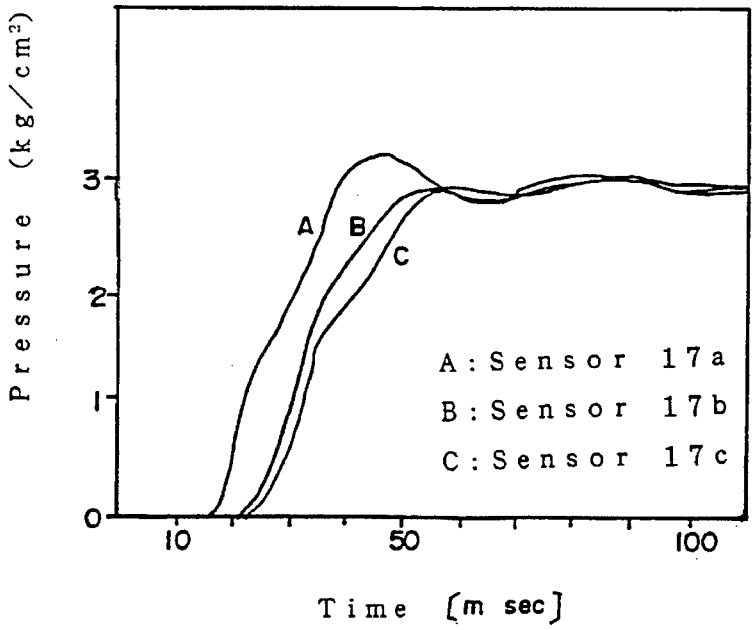
FIG. 5 is a graph to show pressure distribution within the flasks when pressure is applied by conventional compressed air.

The pressure difference was checked using the same rate of pressure increase when compressed air is added to an atmospheric pressure in a conventional manner and when the vacuum air flow of this invention is used (in FIGS. 4 and 5 the rate of pressure increase at the sensor 17*a* is 200 arm/s). In the case of the conventional compressed air flow the pressure in the molding sand at the sensor 17*b* increased 10 ms after the increase in the pressure of the upper part of the molding sand at the sensor 17*b* (see FIG. 5). However, in the case of the vacuum air flow, the time was 20 ms (see FIG. 4). Thus, it has been found that a sufficient pressure difference can be maintained between the upper and lower parts of the molding sand in the case of the vacuum air flow.

In other words, in the conventional compressed air flow the pressure near the pattern plate begins to increase before the compressed air in the upper part of the molding sand reaches the targeted air pressure. In contrast, in the case of the vacuum air flow of this invention, the pressure near the pattern plate begins to increase after the pressure of the upper part of the molding sand reaches the atmospheric pressure.

This is a unique change in pressure in the present invention, and this shows that in a mold-making method by air flow wherein the pressure difference between the upper and lower parts of the sand depends on the degree of compaction of the molding sand, energy can be more effectively used in comparison with the conventional method.

Accordingly, even if the pressure used in the case of the vacuum air flow is less than the pressure used in the conventional compressed air flow method, the energy to be exerted on the molding sand in the case of the vacuum air flow can be greater than in the case of the conventional compressed air flow.

Further, in the conventional compressed air flow method the pressure difference is partially increased by providing vent holes in deep pockets. However, since in this invention a sufficient pressure difference is generated by using a vacuum air flow, such a vent hole can be omitted.

Further, a certain pressure gradient must be maintained for some period so as to give sufficient energy to the molding sand.

When there is a large vibration before the pressure becomes stationary, as shown in FIG. 5, the molding sand vibrates vertically and cracks may be caused in the sand. In contrast, tests indicated that since in the present invention the amplitude of the vibration is small, the mold is sufficiently hard, and no crack is caused.

When mechanical compaction is additionally used in the vacuum air flow method of this invention, the pressing plate 10 is quickly moved and the sand is well compressed. This is because of a great pressure difference between the atmospheric pressure above the pressing plate 10 and the vacuum below it, because the plate 10 is moved by its own weight, because there is no air below the plate 10 which hinders the vacuum air flow and make it slow, and because since there is no air below the plate 10, there will be no air expansion or air reflection after compression which may hinder the compaction of the sand.

Thus, the pressing plate 10 can be lowered to compress the molding sand without using high-pressure air.

As is clear from the above, this invention enables the work environment to be clean because no pressurized air is used. Also, since there is no need to provide vent holes in the pattern plate, the cost to produce pattern plates can be lowered and the surfaces of the products are improved. In the vacuum air flow method pressure increase is made after the pressure is lowered to a certain value close to vacuum and the pressure gradient used can be as low as 15 arm/second, no crack is found on the mold produced, and uniform molds are obtained.

Furthermore, when sand is mechanically compacted by means of vacuum, since compaction is carried out by utilizing the pressure difference between the atmospheric pressure and the vacuum, the device for working the method of this invention can have less rigidity and strength than the conventional device. Also, since compaction is carried out in vacuum, no reflection of air flow is generated that is the cause for a hindrance to the production of molds.

One skilled in the art will appreciate that the present invention can be practiced by other than the described embodiment, which is presented for the purposes of illustration and not of limitation, and that the present invention is limited only by the claims that follow.

What we claim is:

1. In a method of producing a mold that includes the steps of feeding molding sand into a space defined by a pattern plate and a flask mounted on the pattern plate; covering the upper part of the flask by a closing cover; and then pressing the molding sand by using an air flow, wherein the pressing step includes the steps of:

evacuating air from the space enclosed by the pattern plate, the flask, and the closing cover, to make the space a vacuum so that the pressure of the air between the grains of the molding sand in the space is between 1 Tort and 150 Torr; and causing an air flow into the space from an upper part of the space such that the pressure in the space increases to the ambient pressure at a pressure gradient of at least 15 arm/s, thereby compressing the molding sand.

2. The method of claim 1, wherein the air flow is caused by the ambient pressure.

3. The method of claim 1, further comprising the step of mechanically pressing the upper surface of the molding sand after compressing the sand by the air flow.

4. The method of claim 3, wherein the step of mechanically pressing the upper surface of the molding sand includes the steps of:

inserting a pressing plate in the space within the closing cover in a sealing relationship therewith and fixedly supporting the pressing plate in the cover;

evacuating air from the space enclosed by the pattern plate, the flask, the closing cover, and the pressing plate, to make the space a vacuum; and releasing the pressing plate from the closing cover while maintaining the vacuum in the space, thereby lowering the pressing plate by the pressure difference between the ambient pressure exerted on the plate and the vacuum, to press the molding sand.

5. The method of claim 4, wherein the molding sand is pressed by using a split head suspended from the pressing plate through springs such that the head can be retracted.

6. A method of producing a mold comprising the steps of:

feeding molding sand into a space defined by a pattern plate and a flask mounted on the pattern plate;

covering an upper part of the flask by a closing cover;

evacuating air from a space enclosed by the pattern plate, the flask, and the closing cover, to create a vacuum so that the pressure in the space is between 1 and 150 Tort;

pressing the molding sand by introducing an air flow into the space from an upper part of the space such that the pressure in the space increases from the vacuum to ambient pressure at a pressure gradient of at least 15 arm/s, thereby compressing the molding sand.

* * * * *

UNITED STATES PATENT AND TRADEMARK OFFICE

CERTIFICATE OF CORRECTION

PATENT NO. : 5,558,148

DATED : September 24, 1996

INVENTOR(S) : NAGATO UZAKI ET AL.

It is certified that error appears in the above-indentified patent and that said Letters Patent is hereby corrected as shown below:

In the title page at the Assignee, please delete "Sintokogia" and insert --Sintokogio--.

In Col. 1, line 55, please delete "1 Tort to 150 Tort" and insert --1 Torr to 150 Torr--.

In Col. 3, line 49, please delete "(in Tort)" and insert --(in Torr)--.

In Col. 3, line 56, please delete "1 Torr to 150 Tort" and insert --1 Torr to 150 Torr--.

In Col. 3, line 56, please delete "1 Tort to 100 Torr" and insert --1 Torr to 100 Torr--.

In Col. 3, line 57, please delete "1 Tort to 50 Tort" and insert --1 Torr to 50 Torr--.

In Col. 3, line 58, please delete "1 Tort" and insert --1 Torr--.

In Col. 3, line 60, please delete "150 Tort" and insert --150 Torr--.

In Col. 4, line 3, please delete "1 Tort" and insert --1 Torr--.

In Col. 4, line 12, please delete "15 arm" and insert --15 atm--.

In Col. 4, line 25, please delete "arm/s" and insert --atm/s--.

In Col. 4, line 29, please delete "20 ms" and insert --20 ms--.

In Col. 5, line 21, please delete "15 arm/" and insert --15 atm/--.

In Col. 6, line 3, please delete "Tort" and insert --Torr--.

In Col. 6, line 7, please delete "arms/s" and insert --atm/s--.

UNITED STATES PATENT AND TRADEMARK OFFICE

CERTIFICATE OF CORRECTION

PATENT NO. : 5,558,148
DATED : September 24, 1996
INVENTOR(S) : NAGATO UZAKI ET AL.

It is certified that error appears in the above-indentified patent and that said Letters Patent is hereby corrected as shown below:

In Col. 6, line 39, please delete "Tort" and insert --Torr--.

In Col. 6, line 44, please delete "arms/s" and insert --atm/s--.

Signed and Sealed this

First Day of April, 1997

*Attest:*

Bruce Lehman

BRUCE LEHMAN

*Attesting Officer*

*Commissioner of Patents and Trademarks*